United States Patent [19]

Finsterwalder

[11] Patent Number: 4,594,827

[45] Date of Patent: Jun. 17, 1986

[54] TENSION MEMBER, PARTICULARLY FOR USE AS A DIAGONAL CABLE IN A STAYED GIRDER BRIDGE

[75] Inventor: Klemens Finsterwalder, Berg, Fed. Rep. of Germany

[73] Assignee: Dyckerhoff & Widmann Aktiengesellschaft, Munich, Fed. Rep. of Germany

[21] Appl. No.: 779,591

[22] Filed: Sep. 24, 1985

Related U.S. Application Data

[63] Continuation of Ser. No. 426,189, Sep. 28, 1982.

[30] Foreign Application Priority Data

Sep. 30, 1981 [DE] Fed. Rep. of Germany ..... 3138807

[51] Int. Cl.[4] ..... E04C 3/10

[52] U.S. Cl. ..... 52/230; 52/223 L

[58] Field of Search ..... 52/230, 223 R, 223 L, 52/698; 405/260, 259, 262

[56] References Cited

U.S. PATENT DOCUMENTS

| | | | |
|---|---|---|---|
| 2,728,978 | 1/1956 | Birkenmaier et al. | 52/230 |
| 2,751,660 | 6/1956 | Nakonz | 52/230 |
| 3,307,310 | 3/1967 | Kourkene | 52/230 |
| 3,437,359 | 4/1969 | Hunter | 52/230 |
| 3,803,785 | 4/1974 | Finsterwalder et al. | 52/230 |
| 3,967,421 | 7/1976 | Dufossez | 52/230 |
| 4,223,497 | 9/1980 | Edwards | 52/230 |
| 4,235,055 | 11/1980 | Schambeck | 52/230 |
| 4,473,915 | 10/1984 | Walder | 52/230 |

FOREIGN PATENT DOCUMENTS

| | | | |
|---|---|---|---|
| 185089 | 3/1956 | Austria | 52/230 |
| 222320 | 7/1962 | Austria | 52/230 |
| 502865 | 5/1951 | Belgium | 52/230 |
| 1508650 | 1/1968 | France | 52/230 |
| 646855 | 9/1962 | Italy | 52/230 |
| 70297 | 4/1946 | Norway | 52/230 |
| 370221 | 8/1963 | Switzerland | 52/230 |
| 444441 | 2/1968 | Switzerland | 52/230 |

*Primary Examiner*—Carl D. Friedman
*Assistant Examiner*—Michael Safavi
*Attorney, Agent, or Firm*—Toren, McGeady, Stanger, Goldberg & Kiel

[57] ABSTRACT

A tension member is secured at each end to a separate anchoring system for transferring the tensile force from the member to a support structure. The tension member is made up of individual elements disposed in parallel over an axial length located between the ends. After the individual elements are tensioned, open spaces around the elements within the tubular casing are filled with cement grout. Between the tubular casing and each anchoring disc the individual elements extend through and are guided within an anchoring pipe. One end of each anchoring pipe bears against the associated anchoring disc and supports the anchoring disc. A radially outwardly and inwardly projecting annular collar is formed in the anchoring pipe and the collar forms an outwardly extending annular shoulder for transferring the load from the anchoring disc to the support structure. Since the collar is spaced from the anchoring disc, the stress developed due to live loads in the tension member in the axially extending region between the collar and the anchoring disc, is reduced at least in part due to the compressive forces which prevail in this region of the anchoring pipe. Accordingly, alternating stresses caused by live loads do not reach the location where the individual elements are secured to the anchoring disc. Such an arrangement improves the fatigue strength of the tension member.

7 Claims, 6 Drawing Figures

TENSION MEMBER, PARTICULARLY FOR USE AS A DIAGONAL CABLE IN A STAYED GIRDER BRIDGE

This is a continuation of application Ser. No. 426,189, filed Sept. 28, 1982.

SUMMARY OF THE INVENTION

The present invention is directed to a stressed tension member anchored at its ends within anchoring systems for transferring the tensile stress to a support structure. The tension member is unsupported between the anchored ends. There is no composite action between the tension member and the support structure. In particular, the tension member is useful as a diagonal cable in a stayed girder bridge and is made up of a plurality of individual elements, such as steel rods, steel wires or steel strands, disposed in parallel relation within a tubular casing located around and between the anchoring systems. After tensioning of the member has been effected, cement grout is introduced into the tubular casing around the individual elements.

Tension elements of this general type are especially useful as diagonal cables for stayed girder bridges. In bridge structures, in addition to quiescent loads, that is dead loads, dynamic loads also occur as a result of alternating live loads. Such tension members usually fail in the region where they are anchored due to the vibration stresses resulting from alternating loads. Accordingly, a requirement of such members is to keep, if possible, alternating stresses away from the anchoring systems. In addition, another requirement is that such tension members must be longitudinally or axially movable with respect to the support structure so that the tension members can be retensioned or replaced, if necessary.

In a known tension member of this general type, a tubular casing extends into the support structure and consists, at least in the region where it enters the structure, of a metal jacket in composite action with the individual elements and also with the concrete part of the structure, note German Patent No. 21 14 863. The fatigue strength or vibration strength of such a tension member is improved, because the live loads are introduced into the structure separately from the dead loads. Such separate introduction occurs because the individual elements are tensioned and anchored to the structure. In this manner, dead loads, already present in this stressed condition of the tension member, are applied into the structure. Subsequently, the hollow or open spaces between the individual elements and the tubular casing are filled with cement grout. Since live loads are developed only after the injection of grout into the hollow or open spaces, that is, when there is composite action due to the presence of the grout between the individual elements, the steel jacket and the concrete structural part in which the entire tension member is anchored, the variable loads are applied by means of the individual elements into the steel jacket and then transferred from the jacket directly into the concrete structural part. Since the steel jacket is in composite action with the concrete structural part, such a tension member cannot be replaced.

In a known replaceable tension member disclosed in German Patent No. 27 53 112, in the region where the tension member enters the concrete structural part, the tubular casing is widened and an increased thickness part annularly surrounds the tension member and forms a support surface. Additional stressing elements are disposed radially around the tension member and extend into the concrete structural part but without any composite action with the part. These stressing elements are detachably anchored at one end inside the increased thickness part of the tubular casing and at the other end on the outside of the concrete structural part. These stressing elements are dimensioned and stressed so that, under the compressive force generated by these elements in the support surface, even at maximum live load, the joint at the support surface does not open, that is, the tension member under such load conditions does not experience any alternating stress in the region where it is anchored.

Therefore, the primary object of the present invention is to provide a simpler arrangement for a tension member of the above-described type with the tension member arranged so that it is not in composite action with the support structure and thus can be replaced and so that dynamic or live loads can be introduced separately into the support structure from the introduction of the dead loads.

In accordance with the present invention, the individual elements forming the tension member in the region of the anchoring system are guided through a steel anchoring pipe and are secured in an anchoring disc supported against one end of the anchoring pipe. The anchoring disc has openings or bores through which the individual elements extend. Further, the anchoring pipe at a location spaced axially from the anchoring disc has an increased thickness flange or collar-like part which forms a support surface supporting the tension member and the anchoring system on the support structure.

Preferably, the collar-like part is located approximately at the first third point in the axial length of the anchoring pipe from the anchoring disc.

In an embodiment of the present invention, the tubular casing of the tension member is formed as a rigid metal casing disposed in overlapping relation with the anchoring pipe. In the axial region of the overlap, means are arranged to provide or improve the shear connection between the rigid metal casing and the anchoring pipe. In a preferred arrangement, the rigid metal casing has a smaller outside diameter than the inside diameter of the anchoring pipe so that the casing extends into the anchoring pipe.

Finally, the anchoring pipe may have an inwardly directed flange in the region of the transition to the casing.

It is the basic concept of the invention that in the region of the anchoring system, a steel anchoring pipe is arranged in composite action with the individual elements anchored into an anchoring disc with the end of the anchoring pipe supporting the anchoring disc. The entire anchoring force is transmitted into the support structure by an increased thickness collar-like part formed on and extending around the anchoring pipe with the collar-like part spaced axially from the anchoring disc. In this manner, the bonding stresses in the region between the collar-like part and the anchoring disc which occur in the stressed tension member due to live loads, are reduced to a considerable extent by compressive forces which prevail in the anchoring pipe in this region, with the result that such stresses do not reach the location of the anchors for the individual elements at the anchoring disc.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
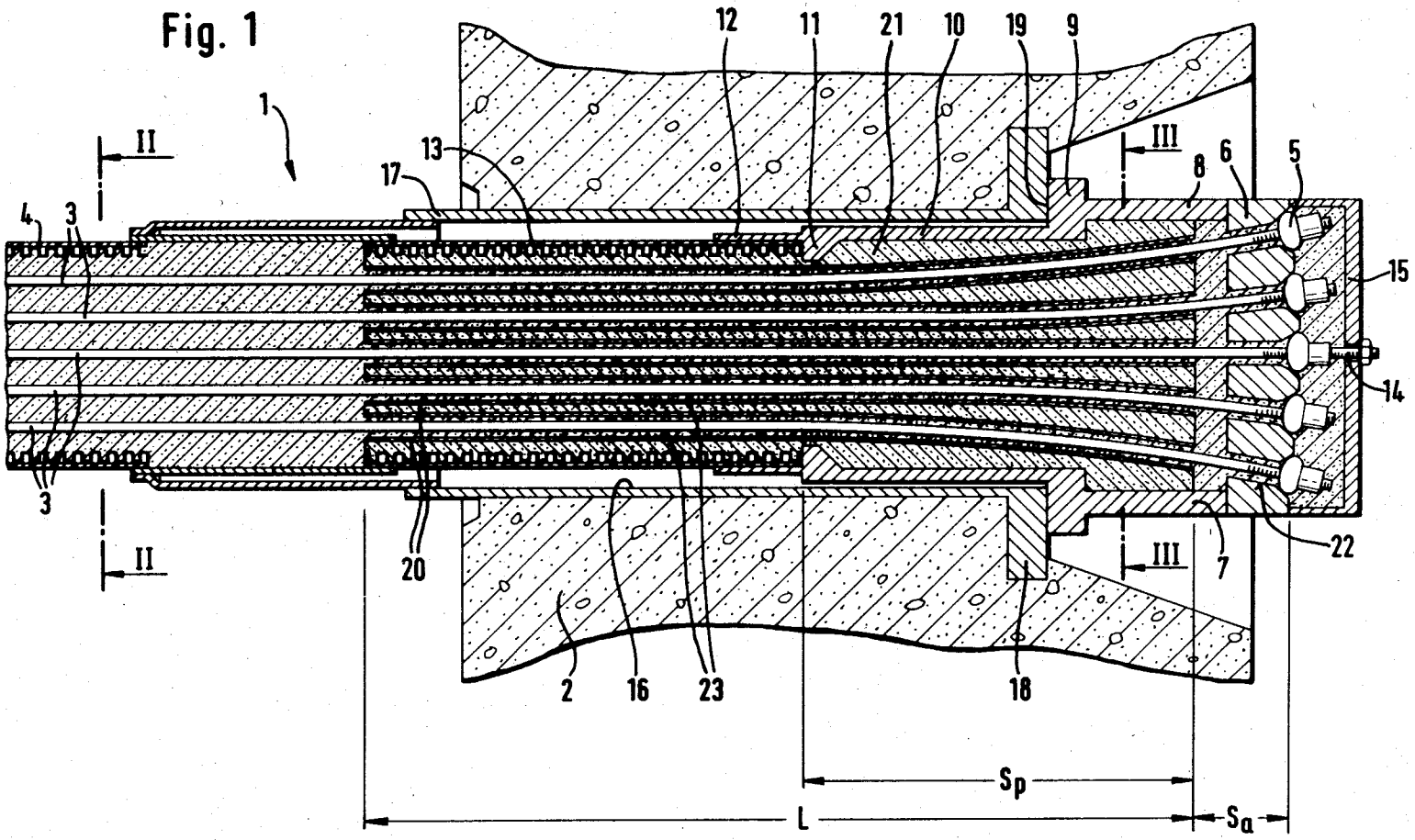
FIG. 1 is an axially extending sectional view through the anchoring region of a tension member embodying the present invention.

In FIG. 1 one end of a tension member 1 is shown anchored in a concrete support structure 2, such as a tower or roadway support in a stayed girder bridge.

Tension member 1 is made up of a number of individual elements 3 in the form of steel rods, steel wires or steel strands. The number of individual elements depends on the load to be carried by the tension member. As viewed in FIG. 1, the right hand end of the tension member 1 is anchored and the left hand portion extending from the structural support 2 is unsupported, that is, it is free for its axial length to the other anchored end. In the unsupported part of the tension member the individual elements are laterally enclosed by a tubular casing 4 which may be formed of a plastics material.

In the illustrated embodiment, the individual elements 3 are steel rods or steel wires. In any case, the individual elements, at least at their ends, are provided with threads and are anchored to an anchoring disc 6 by anchor nuts 5.

Anchoring disc 6 extends transversely of the axial direction of the tension member and is supported against the outer end of an axially extending anchoring pipe 7. While the individual elements 3 are in parallel relation within the tubular casing 4 and as they extend into the support structure 2, as they approach the anchoring disc 6 the individual elements are spaced further apart, that is, they are no longer in parallel relation. Accordingly, anchoring pipe 7 has an increased inside diameter part 8 which extends axially from the anchoring disc 6 to a transition section formed by an increased thickness annular collar or flange-like part 9. The collar-like part 9 projects radially outwardly from and inwardly from the outside and inside surfaces of the part 8. A smaller diameter part 10 of the anchoring pipe 7 extends from the radially inner surface of the collar-like part 9. Part 10, as shown, has a smaller wall thickness than part 8 since there is less stress experienced in the axial region of part 10. The end of part 10 spaced further from the anchoring disc 6 has an inwardly directed flange 11 having a greater thickness than the part 10. Extending axially from the flange-like part 11 is a tubular projection 12 having a considerably smaller thickness than the part 10 with the outside diameter of the tubular projection being considerably less than that of part 10. The smaller outside diameter of the tubular projection 12 serves as a connection for a tubular sheath 13 inserted into the tubular projection 12. Tubular sheath 13 is formed of plastics material, as is the tubular casing 4.

In FIG. 1 the tension member 1 is shown in its final or stressed state with the anchor nuts 5 secured onto the projecting ends of the individual elements 3. The projecting ends are protected by a cover cap 15 held in position by an extended individual element and a nut 14 securing the cover against the anchoring disc 6.

Tension member 1 extends through the opening formed in the concrete support structure 2 through a duct 16 formed by a steel pipe 17. At the end of the steel pipe 17 closer to the anchoring disc 6, there is a radially outwardly extending flange-like abutment plate 18 against which the collar-like part 9 on the anchoring pipe 7 is supported via a support surface 19. The entire tensile force of the tension member 1 is applied to the concrete structural support 2 by the support surface 19.

Within the anchoring region of the tension member for the length L, the individual members each extend through an individual sheath 20. Each sheath 20 is fixed in position within the tubular sheath 13 and the anchoring pipe 7 by a primary injection of cement grout 21. The position of the tubular sheaths 20 is fixed so that the individual elements 3, when they are inserted through the tubular sheaths from the ends spaced more remotely from the anchoring disc 6, are guided into the bores 22 in the anchoring disc. In other words, the axes of the individual sheaths 20 are aligned with the corresponding bores 22 in the anchoring disc 6 so that the individual elements 3 are properly guided toward the anchoring disc.

Figure 2:
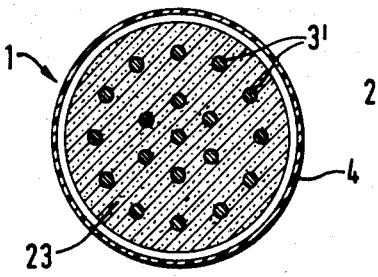
FIG. 2 is a cross-sectional view through the tension member in the unsupported region taken along the line II—II in FIG. 1.
Figure 3:
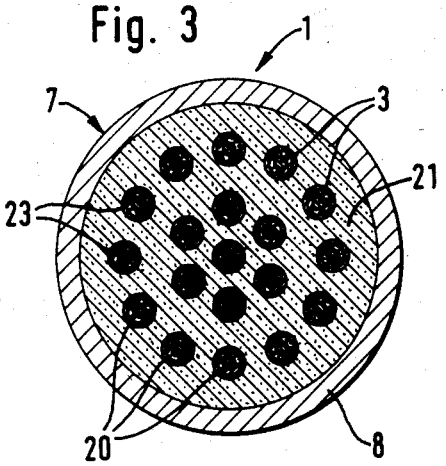
FIG. 3 is a cross-sectional view through the tension member in the region of the anchoring pipe taken along the line III—III in FIG. 1.

After the individual elements 3 are tensioned and anchored, any hollow or open spaces remaining around the individual elements within the tubular sheath 4 or between the individual elements 3 and the tubular sheaths 20 are filled with a secondary injection of cement grout 23, note FIGS. 2 and 3. In the final condition of the tension member 1, all individual elements are completely enclosed in cement grout which provides corrosion protection and effects a composite action between the individual elements and the anchoring pipe.

Between the anchoring region defined by the axial length L and the anchoring disc 6, the quiescent loads from the dead weight are applied in the axially extending region of a so-called active final anchoring $S_a$ which results during the tensioning of the individual elements 3. Spaced outwardly from the final anchoring $S_a$ there is another axially extending region $S_p$ of passive self-anchoring where, after the cement grout 21, 23 of the primary injection and the secondary injection is in place, the live loads which occur in addition to the dead loads are transferred directly to the anchoring pipe by means of bonding stresses without impairing the final anchoring at the anchoring disc 6. The flange-like part 11 introduces shearing forces into the anchoring pipe 7. Such shearing forces result from the bonding stresses along the anchoring pipe 7.

Due to the absorption of live loads in the axially extending region of passive self-anchoring designated by the length $S_p$, a reduction in the bonding stresses is achieved in the region of the part 8 spaced from the anchoring disc so that the collar-like part 9 of the anchoring pipe is located approximately at the third point of the overall length of the anchoring pipe, that is the third point located closer to the anchoring disc 6. The reduction in bonding stresses is achieved, because this region of the anchoring pipe 7, due to the supporting force transmitted from the anchoring disc with the final anchorings for dead weight, is prestressed to a high degree for compression.

Figure 5:
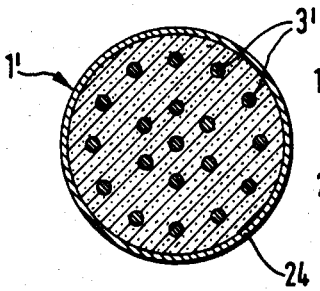
FIG. 5 is a sectional view taken along the line V—V in FIG. 4.
Figure 6:
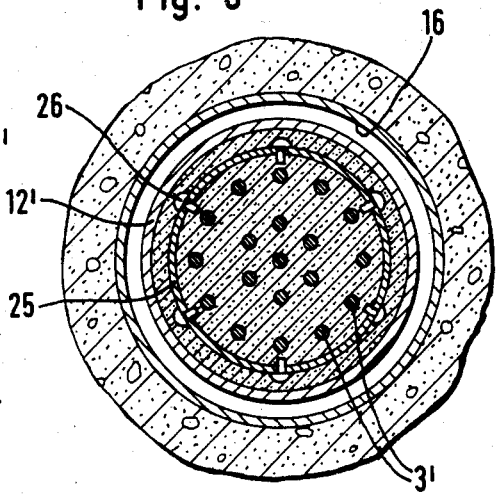
FIG. 6 is a cross-sectional view taken along the line VI—VI in FIG. 4.
Figure 4:
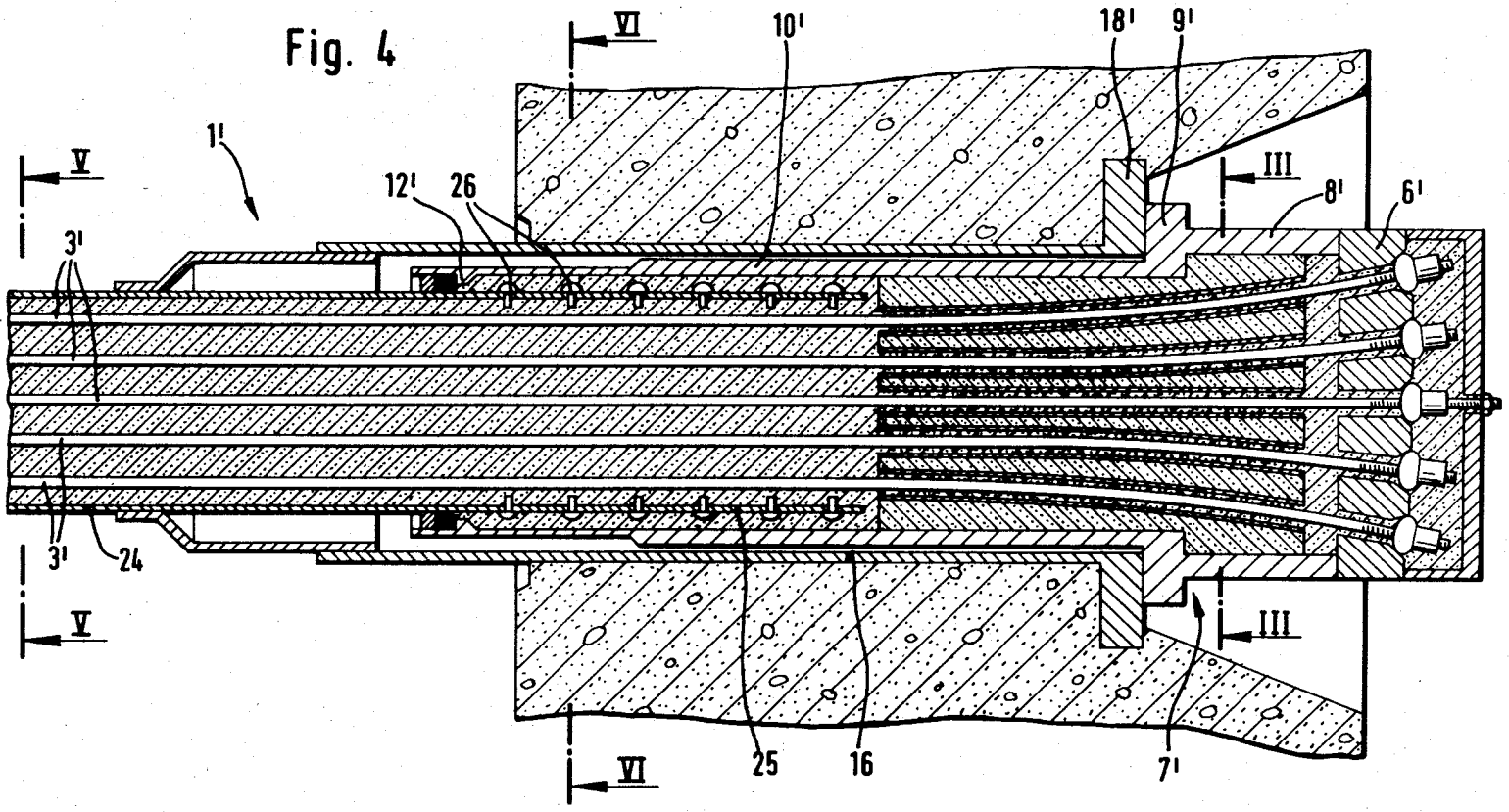
FIG. 4 is an axially extending sectional view through the anchoring region of another embodiment of the tension member incorporating the present invention.

In FIGS. 4 to 6, another embodiment of the present invention is disclosed with a tension member 1' shown extending through a tubular casing 24 formed of a rigid metal jacket. In this embodiment, the tensile forces from the unsupported region of the tension member are transmitted not only by the individual elements 3' but also by the rigid metal jacket of the casing 24 and must be released to the anchoring system. This transfer takes place where the casing 24 extends into the end of the anchoring pipe 7' spaced from the anchoring disc 6'. In the axially extending region where the anchoring pipe 7' overlaps the casing 24, rivets 26 are provided to afford or improve the shear connection between the casing 24 and the anchoring pipe 7'.

Casing 24 has a smaller outside diameter than the adjacent end of the anchoring pipe 7' so that it extends into the part 10' of the anchoring pipe. The inner part 10' of the anchoring pipe 7' is, as shown in the embodiment of FIGS. 1 to 3, provided with an axially extending tubular part 12' which is of a reduced thickness compared to the part 10' and laterally encloses the casing 24.

In this embodiment, the forces in the axially extending region of the overlap 25 are transferred in part due to the composite action of the casing 24 with the part 10' of the anchoring pipe 7' and are transferred through the collar-like part 9' to the abutment plate 18'. Further, the forces are partially transferred from the individual elements 3' directly to the anchoring plate 6' which is supported against the adjacent end of the part 8' of the anchoring pipe 7'.

While specific embodiments of the invention have been shown and described in detail to illustrate the application of the inventive principles, it will be understood that the invention may be embodied otherwise without departing from such principles.

I claim:

1. A stressed tension member anchored at the ends thereof for transferring tensile force into a support structure and being unsupported between the ends, said tension member being free of composite action with the support structure, said tension member can be used as a diagonal cable for a stayed girder bridge and is comprised of a plurality of individual elements, such as steel rods, steel wires or steel strands, with said individual elements disposed in parallel relation for an axially extending length thereof between the ends of said tension member, an axially extending tubular casing laterally enclosing said parallel individual elements, and a cement grout filled into the open spaces within said tubular casing around said individual elements after said individual elements are tensioned, an anchoring system for an end of said individual elements comprising an anchoring disc having a plurality of bores extending therethrough and arranged to receive one of said individual elements in each of said bores, means for securing said individual elements to said anchoring disc, wherein the improvement comprises that said anchoring disc is spaced along said individual elements from the adjacent end of said tubular casing, an axially extending steel anchoring pipe is located and extends between said anchoring disc and said tubular casing and laterally encloses said individual elements extending therebetween, said individual elements arranged to be enclosed by a groutOlike material within said anchoring pipe between said anchoring disc and the adjacent said tubular casing, said anchoring pipe having a first end and second end spaced apart in the axial direction of said anchoring pipe, the first end of said anchoring pipe is disposed in contact with said anchoring disc and said anchoring pipe is arranged to support said anchoring disc on the support structure, the second end of said anchoring pipe is located adjacent to said tubular casing, said anchoring pipe includes an annular collar encircling said individual elements and spaced between and from the first and second ends of said anchoring pipe so that said collar is spaced from said anchoring disc, and said annular collar forms a support shoulder for supporting said tension member on the support structure so that the support for said anchoring disc on the support structure is spaced in the axial direction of said anchoring pipe from said anchoring disc and is located between the first and second ends of said anchoring pipe.

2. A stressed tension member, as set forth in claim 1, wherein said collar on said anchoring pipe is located approximately at a one third point of the axial length of said anchoring pipe which third point is closer to said anchoring disc.

3. A stressed tension member, as set forth in claim 1, wherein said tubular casing comprises a rigid metal jacket, said tubular casing and said anchoring pipe are disposed in overlapping relation, and means located in the overlapping region for effecting a shear connection between said tubular casing and said anchoring pipe.

4. A stressed tension member, as set forth in claim 3, wherein said tubular casing has a smaller outside diameter than the inside diameter of the adjacent part of said anchoring pipe at the second end thereof so that said tubular casing extends into the adjacent second end of said anchoring pipe.

5. A stressed tension member, as set forth in claim 2, wherein said anchoring pipe has a radially inwardly directed flange adjacent the second end of said anchoring pipe more remote from said anchoring disc.

6. A stressed tension member, as set forth in claim 4, wherein said anchoring pipe has a radially inwardly directed flange at a point where the pipe overlaps the casing.

7. A stressed tension member, as set forth in claim 3, wherein said anchoring pipe has a radially inwardly directed flange adjacent the second end of said anchoring pipe more remote from said anchoring disc.

* * * * *